US010303107B2

(12) United States Patent
Fujita et al.

(10) Patent No.: US 10,303,107 B2
(45) Date of Patent: May 28, 2019

(54) IMAGE FORMING SYSTEM

(71) Applicant: CANON KABUSHIKI KAISHA, Tokyo (JP)

(72) Inventors: Takashi Fujita, Kashiwa (JP); Nobuhiro Tani, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/398,345

(22) Filed: Jan. 4, 2017

(65) Prior Publication Data

US 2017/0115621 A1 Apr. 27, 2017

Related U.S. Application Data

(63) Continuation of application No. 14/855,681, filed on Sep. 16, 2015, now Pat. No. 9,575,457.

(30) Foreign Application Priority Data

Sep. 19, 2014 (JP) ..... 2014-191047

(51) Int. Cl.
*G03G 21/16* (2006.01)
*G03G 15/00* (2006.01)

(52) U.S. Cl.
CPC ..... *G03G 15/80* (2013.01); *G03G 15/5016* (2013.01); *G03G 2215/0129* (2013.01)

(58) Field of Classification Search
CPC ..... G03G 15/5016
See application file for complete search history.

(56) References Cited

U.S. PATENT DOCUMENTS 3,598,920 A 8/1971 Fischer et al.
4,733,840 A * 3/1988 D'Amore ..... E05B 73/0005 248/205.3
5,454,067 A 9/1995 Tsai
6,512,914 B2 1/2003 Kabashima
7,140,572 B2 11/2006 Glass
7,176,898 B2 2/2007 Litwiller
(Continued)

FOREIGN PATENT DOCUMENTS

JP 61-083669 U 6/1986
JP 03-85550 A 4/1991
(Continued)

OTHER PUBLICATIONS

Machine translation of Jun. 5, 2018 Japanese Office Action.*
Office Action dated Jun. 5, 2018, in Japanese Patent Application No. 2014-191047.

*Primary Examiner* — Clayton E. LaBalle
*Assistant Examiner* — Leon W Rhodes, Jr.
(74) *Attorney, Agent, or Firm* — Venable LLP

(57) ABSTRACT

An image forming apparatus has an apparatus body having an image forming portion capable of forming an image based on an image information, an operation unit disposed as a separate body from the apparatus body and operating the apparatus body, and a cable connecting the apparatus body and the operation unit and capable of conducting power. The cable has a length set so that the operation unit does not contact an installation surface on which the apparatus body is supported, according to which a freedom of placement of the operation unit is improved compared to a case where the operation unit is connected via an arm.

51 Claims, 9 Drawing Sheets

(56) References Cited

U.S. PATENT DOCUMENTS

| | | | | |
|---|---|---|---|---|
| 7,292,287 | B2 | 11/2007 | Horiuchi | |
| 7,477,329 | B2 | 1/2009 | Horiuchi | |
| 7,565,824 | B1 * | 7/2009 | Gleason | E05B 73/0005 248/552 |
| 8,482,556 | B2 | 7/2013 | Meunier et al. | |
| 8,624,120 | B2 | 1/2014 | Hong | |
| 9,420,131 | B2 | 8/2016 | Tani et al. | |
| 9,640,050 | B2 * | 5/2017 | Banaczuk | G08B 13/12 |
| 2009/0185845 | A1 | 7/2009 | Hata | |
| 2012/0097425 | A1 | 4/2012 | Sakai et al. | |

FOREIGN PATENT DOCUMENTS

| | | | | |
|---|---|---|---|---|
| JP | 06-002364 | U | | 1/1994 |
| JP | 08-038740 | A | | 2/1996 |
| JP | 08-98162 | A | | 4/1996 |
| JP | 2000-101701 | A | | 4/2000 |
| JP | 2005-027230 | A | | 1/2005 |
| JP | 2006-347091 | A | | 12/2006 |
| JP | 2009-175314 | A | | 8/2009 |
| JP | 2010-049169 | A | | 3/2010 |
| JP | 2010-191165 | A | | 9/2010 |
| JP | 2010-243977 | A | | 10/2010 |
| JP | 2010243977 | A | * | 10/2010 |
| JP | 2011-059422 | A | | 3/2011 |
| JP | 2011-077959 | A | | 4/2011 |
| JP | 2016-057442 | A | | 4/2016 |
| WO | 2006/016464 | A1 | | 2/2006 |

* cited by examiner

IMAGE FORMING SYSTEM

This application is a continuation of U.S. patent application Ser. No. 14/855,681, filed Sep. 16, 2015, and which claims the benefit of Japanese Patent Application No. 2014-191047, filed Sep. 19, 2014 which are hereby incorporated by reference herein in their entireties.

BACKGROUND OF THE INVENTION

Field of the Invention

The present invention relates to an image forming system.

Description of the Related Art

In the prior art, an image forming apparatus adopting an electro-photographic system is applied widely as a copier, a printer, a plotter, a facsimile machine, or a multifunction printer having such multiple functions. An operation unit is provided for the image forming apparatus through which a user can switch operations and enter detailed settings of the respective operations. Such operation unit is often disposed in a fixed manner on an upper surface of an apparatus body, but recently, large-sized liquid crystal panels are starting to be adopted, so that if the operation unit is arranged in a fixed manner on the upper surface of the apparatus body, there is a limit to the size of the operation unit capable of being installed to the apparatus body.

Therefore, for example, Japanese Patent Application Laid-Open Publication No. 2006-347091 discloses an image forming apparatus where an operation unit is disposed as a separate body from the apparatus body, and supported movably by an arm, according to which a large-sized liquid crystal panel can be disposed, regardless of the area or the shape of the upper surface of the apparatus body. In such image forming apparatus, the operation unit can be switched between a state where it is positioned frontward at a right side of the apparatus body and a state where it is positioned at an upper center portion of a front portion of the apparatus body, wherein the operation unit can be used in both states.

However, in the above-described image forming apparatus, the operation unit can only be moved between the front right side area and the center front side area of the apparatus body, so that it has the following drawbacks.

When failure occurs to the image forming apparatus, for example in order to specify the cause of failure, a service person must use the operation unit to confirm various data displayed on the operation unit and enter special operation settings, while checking the actual action of the image forming apparatus. Therefore, if the operation unit is positioned remote from the failure location, the service person must move back and forth for confirmation operation, so that excessive time is required for movement, and speedy recovery is thereby hindered.

For example, in an example where the image forming apparatus is used alone in a normal office or the like, the distance back-and-forth movement required during the confirmation operation is not so long, so that it will not become a problem. On the other hand, for example, in an image forming system capable of performing on-demand printing using a sheet feeding apparatus, a finisher and the like in addition to the image forming apparatus, the distance of back-and-forth movement becomes longer compared to the case where the image forming apparatus is used alone. Especially when the maintenance operation is performed at the rear side of the image forming apparatus, the service person must move back and forth to the front and rear sides of the image forming apparatus, and the work time and work labor will be further increased in the image forming system since the service person must take a detour around other devices.

In the above-described image forming apparatus, the operation unit can only move between the front right side and the front center area of the apparatus body, so that it has a drawback that when the apparatus is applied to a large-scale image forming system as described, the distance of back-and-forth movement of the service person during failure becomes excessive. Moreover, it may also be possible to extend the length of the arm movably supporting the operation unit on the above-described image forming apparatus, with the aim to enhance the degree of freedom of movement of the operation unit. However, for example, if an arm long enough to allow the operation unit to reach the sheet feeding apparatus or the finisher of the above-mentioned image forming system is to be provided, an extremely long arm becomes necessary, so that not only the cost is increased, but the long arm itself may disturb the maintenance operation.

SUMMARY OF THE INVENTION

According to one aspect of the invention, an image forming system comprising: an apparatus body having an image forming portion capable of forming an image based on an image information; an operation unit provided separately and movably with the apparatus body so as to be placed on the apparatus body and configured to operate the apparatus body; and a cable positioned and configured to electrically connect the apparatus body and the operation unit such that the operation unit does not reach an installation surface on which the apparatus body is supported.

Further, according to one aspect of the invention, an image forming system comprising: an apparatus body having an image forming portion capable of forming an image based on an image information; an operation unit provided separately and movably with the apparatus body so as to be placed on the apparatus body and configured to operate the apparatus body; a cable positioned and configured to electrically connect the apparatus body and the operation unit; and an adjustment portion positioned and configured to adjust a length of the cable by suspending the cable.

Further features of the present invention will become apparent from the following description of exemplary embodiments with reference to the attached drawings.

DESCRIPTION OF THE EMBODIMENTS

Now, the preferred embodiments of the present invention will be described in detail with reference to FIGS. 1 through 8. In the present embodiments, as shown in the respective drawings, with respect to an image forming apparatus 2, a front side is referred to as a front direction F, a depth side (rear side) is referred to as a rear direction B, a left side is referred to as a left direction L, a right side is referred to as a right direction R, an upper side is referred to as an upper direction U, and a lower side is referred to as a lower direction D.

Figure 1:
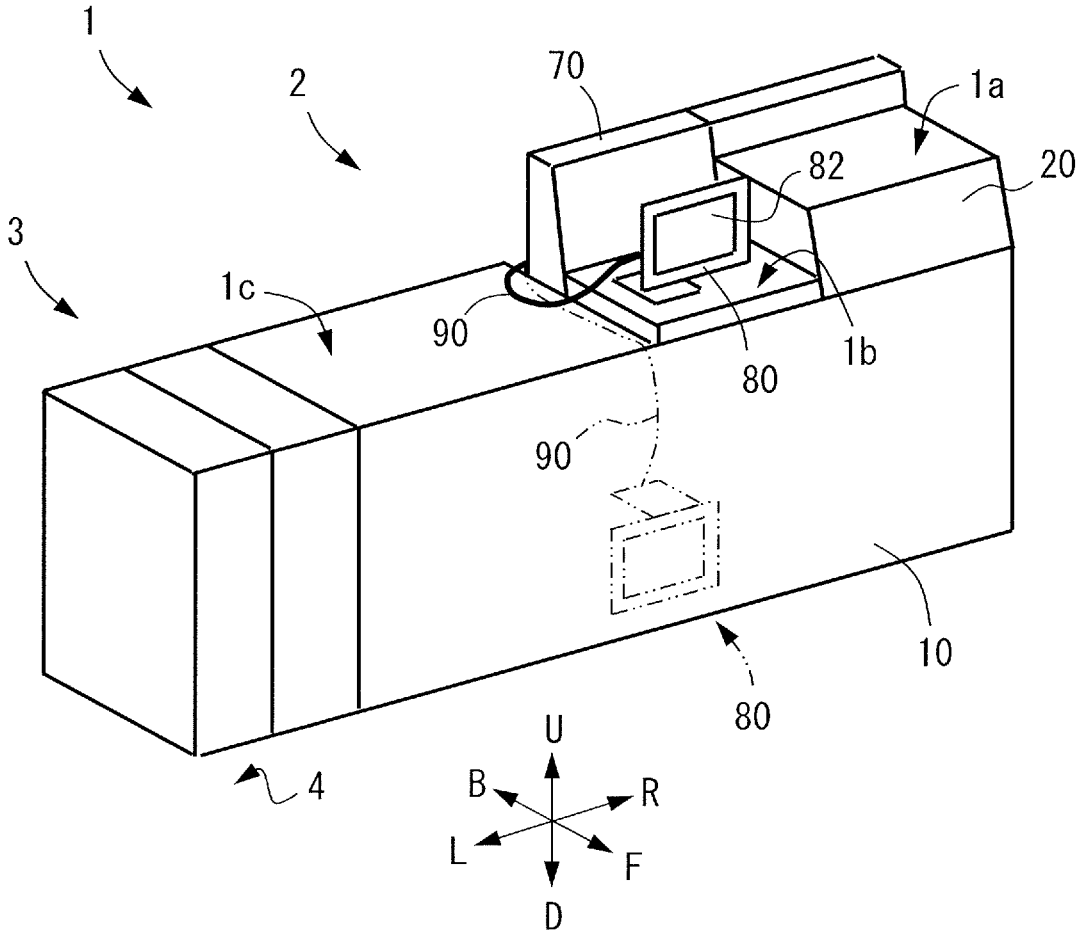
FIG. 1 is a schematic view of an image forming system according to a preferred embodiment.

As shown in FIG. 1, an image forming system 1 according to the present embodiment is equipped with an image forming apparatus 2, such as a printer, and an optional discharge device (a sheet processing device) 3 arranged adjacent to the image forming apparatus 2 on the left direction L side thereof and capable of loading a sheet S on which an image has been formed. Plane surfaces 1*a*, 1*b* and 1*c* available as workspace are provided on an upper surface of the image forming apparatus 2. The respective plane surfaces 1*a*, 1*b* and 1*c* are each designed to be wider than a maximum size of a sheet S (such as A3 size) on which the image forming apparatus 2 can form an image. In the present embodiment, plane surface 1*a* is the highest surface, plane surface 1*c* is the lowest and widest surface, and the plane surface 1*b* is a mounting surface on which an operation unit 80 is placed. Since plane surface 1*c* is wide, for example, a document reading apparatus for scanning a document can be placed thereon.

The present embodiment illustrates a tandem-type full color printer as an example of the image forming apparatus 2. However, the present invention is not restricted to tandem-type image forming apparatuses 2, and the invention can be applied to other types of image forming apparatuses, or even to monochrome or single-color apparatuses instead of full color apparatuses.

Figure 2:
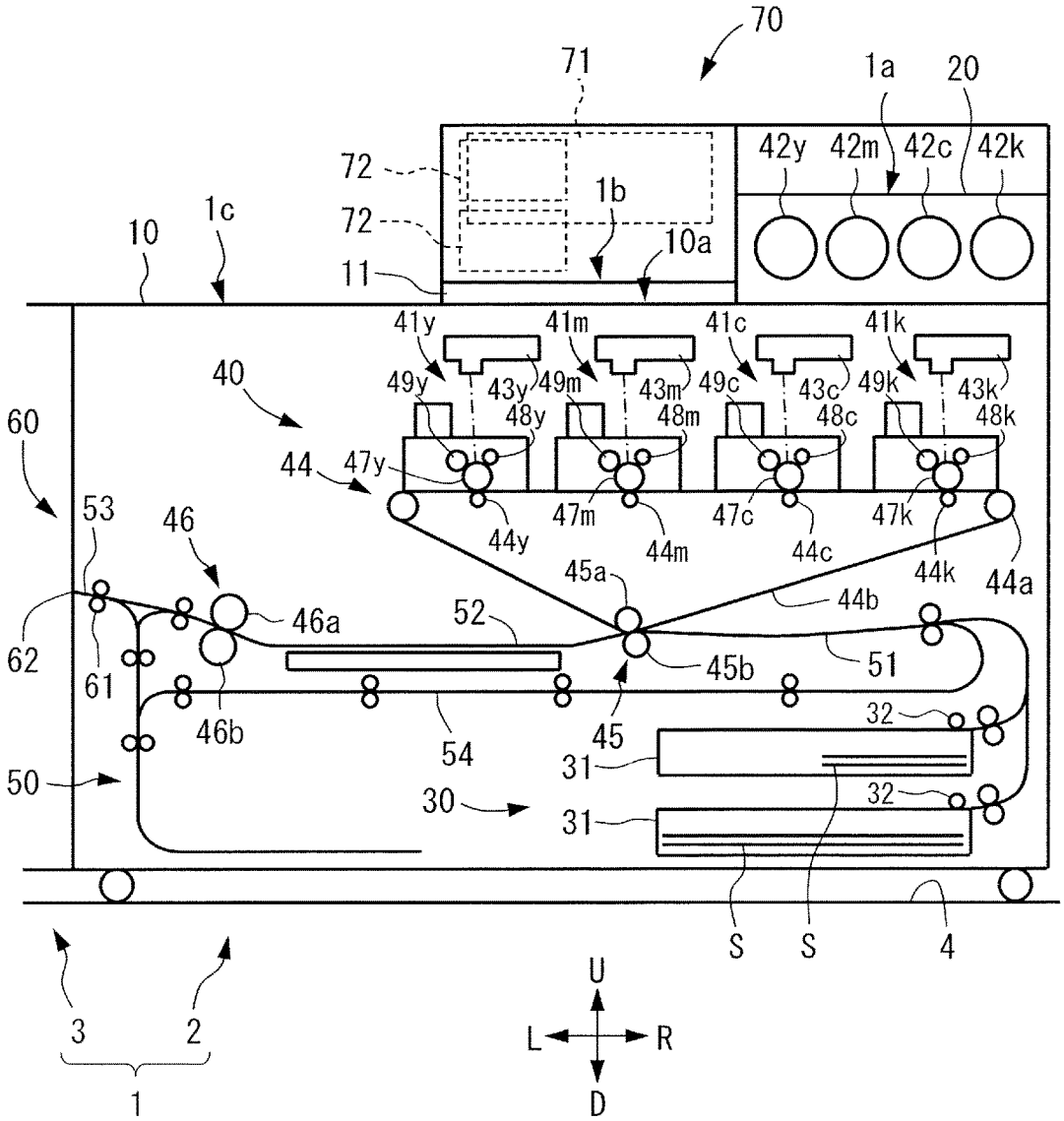
FIG. 2 is a schematic section view of an image forming apparatus according to the preferred embodiment.

As shown in FIG. 2, the image forming apparatus 2 is equipped with an image forming apparatus body (hereinafter referred to as apparatus body) 10. Furthermore, the apparatus body 10 is equipped with a toner supply portion 20, a sheet feeding portion 30, an image forming portion 40, a sheet conveying portion 50, a sheet discharge portion 60, an electrical unit (partition unit) 70, and the operation unit 80. A sheet S, which is a recording member, is a sheet on which a toner image is formed, and actual examples of such sheet include plain paper, synthetic resin sheet as substitute of plain paper, cardboard, OHP sheet, and so on.

The sheet feeding portion 30 is arranged on a lower area of the apparatus body 10, equipped with a sheet cassette 31 loading and storing sheets S and a feeding roller 32, and feeds sheets S to the image forming portion 40.

The image forming portion 40 is equipped with an image forming unit 41, toner bottles 42, an exposure unit 43, an intermediate transfer unit 44, a secondary transfer portion 45 and a fixing unit 46, and forms images.

The image forming unit 41 is equipped with four image forming units 41*y*, 41*m*, 41*c* and 41*k*, for forming toner images of four colors, which are yellow (y), magenta (m), cyan (c) and black (k). Each image forming unit can be attached to or removed from the apparatus body 10 by a user. For example, the image forming unit 41*y* is equipped with a photosensitive drum 47*y* for forming a toner image, a charging roller 48*y*, a developing sleeve 49*y*, a drum cleaning blade (not shown), and a toner and the like. Toner is supplied from the toner bottle 42*y* filled with toner to the image forming unit 41*y*. The other image forming units 41*m*, 41*c* and 41*k* have similar structures as the image forming unit 41*y* except for the difference in toner color, so that detailed descriptions thereof are omitted.

The exposure unit 43*y* exposes the surface of the photosensitive drum 47*y*, and forms an electrostatic latent image on the surface of the photosensitive drum 47*y*.

The intermediate transfer unit 44 is arranged at the lower direction D of the image forming unit 41. The intermediate transfer unit 44 is equipped with a plurality of rollers, such as a drive roller 44*a* and primary transfer rollers 44*y*, 44*m*, 44*c* and 44*k*, and an intermediate transfer belt 44*b* wound around the rollers. The primary transfer rollers 44*y*, 44*m*, 44*c* and 44*k* are arranged to face the photosensitive drums 47*y*, 47*m*, 47*c* and 47*k*, respectively, and are in contact with the intermediate transfer belt 44*b*. By applying a transfer bias of positive polarity to the intermediate transfer belt 44*b* from the primary transfer rollers 44*y*, 44*m*, 44*c* and 44*k*, toner images having negative polarity formed on the photosensitive drums 47*y*, 47*m*, 47*c* and 47*k* are respectively sequentially transferred to the intermediate transfer belt 44*b* in multiple layers. Thereby, a full-color image is formed on the intermediate transfer belt 44*b*.

The secondary transfer portion 45 is equipped with a secondary transfer inner roller 45*a* and a secondary transfer outer roller 45*b*. A full-color image formed on the intermediate transfer belt 44*b* is transferred to the sheet S by applying a secondary transfer bias having positive polarity on the secondary transfer outer roller 45*b*. The secondary transfer inner roller 45*a* stretches the intermediate transfer belt 44*b* in an inner side of the intermediate transfer belt 44*b*, and the secondary transfer outer roller 45*b* is arranged at a position facing the secondary transfer inner roller 45*a* with the intermediate transfer belt 44*b* interposed therebetween.

The fixing unit 46 is equipped with a fixing roller 46*a* and a pressure roller 46*b*. A sheet S is nipped between and transferred by the fixing roller 46*a* and the pressure roller 46*b*, and the toner image transferred onto the sheet S is heated, pressed, and fixed on the sheet S.

The sheet conveying portion 50 is equipped with a pre-secondary-transfer conveying path 51, a pre-fixing conveying path 52, a discharge path 53 and a re-conveying path 54, for conveying the sheet S fed from the sheet feeding portion 30 via the image forming portion 40 to the sheet discharge portion 60.

The sheet discharge portion 60 is equipped with a discharge roller pair 61 arranged on a downstream side of the discharge path 53, and a discharge port 62 arranged on a side area of the left direction L-side of the apparatus body 10. The discharge roller pair 61 feeds the sheet S conveyed from the discharge path 53 via the nip portion, and discharges the sheet from the discharge port 62. The discharge port 62 is capable of feeding the sheet S to the optional discharge device 3 arranged on the left direction L-side of the apparatus body 10. It is noted that the optional discharge device 3 is providing a given processing to a sheet S after image forming.

As shown in FIG. 1 and FIG. 2, an electrical unit 70 is arranged at the rear direction B-side on an upper surface 10*a* of the apparatus body 10 adjacent to the left direction L-side of the toner supply portion 20, and formed to protrude upward from the upper section of the apparatus body 10. An upper cover 11 is arranged on the front direction F-side of the upper surface 10*a* of the apparatus body 10, and an upper surface of the upper cover 11 is formed as a plane surface (mounting surface) 1*b* on which the operation unit 80 can be placed. The electrical unit 70 is arranged at a position deviated from the plane surface 1*b* on the upper surface 10*a* of the apparatus body 10. In the present embodiment, the height from the plane surface 1*b* of the electrical unit 70 is set equivalent to the height of the operation unit 80 placed on the plane surface 1*b*.

Figure 3:
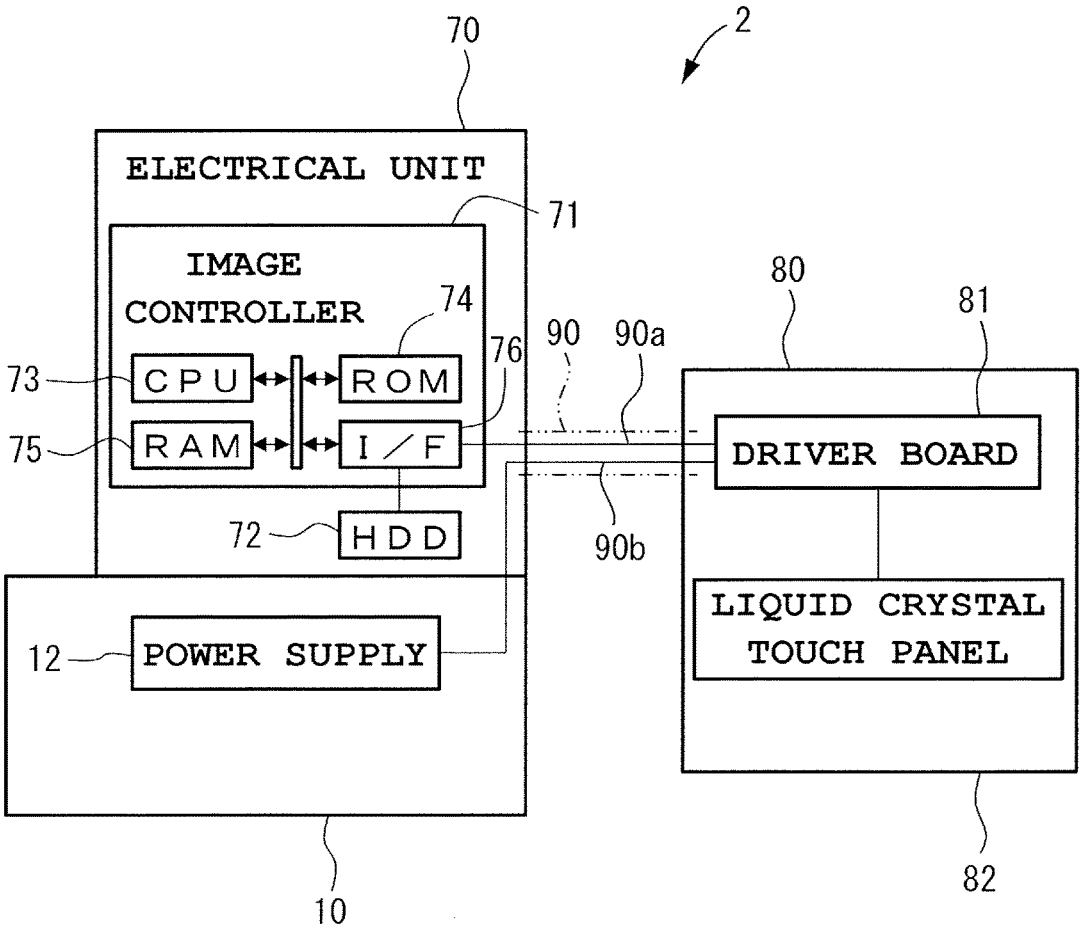
FIG. 3 is a schematic diagram showing a connection relationship between an electrical unit and an operation unit of the image forming apparatus according to the preferred embodiment.

As shown in FIG. 3, the electrical unit 70 has in the interior thereof an image controller 71, which is a control board including a control unit, and a hard disk drive (hereinafter referred to as HDD) 72, which is a removable large-capacity storage device. The image controller 71 is composed of a computer having, for example, a CPU 73, a ROM 74 storing programs for controlling respective portions, a RAM 75 for temporarily storing data, and an input/output circuit (I/F) 76 for inputting and outputting signals from/to an exterior. The HDD 72 is a removable large-capacity storage device for saving electrical data, capable of mainly storing image processing programs, digital image data, and supplementary information of the digital image data. When forming an image, image data is read from the HDD 72.

The CPU 73 is a microprocessor in charge of controlling the whole image forming apparatus 2, and it is the main body of a system controller. The CPU 73 is connected via the input/output circuit 76 to the sheet feeding portion 30, the image forming portion 40, the sheet conveying portion 50, the sheet discharge portion 60, the HDD 72, and the operation unit 80, communicating signals with the respective portions and controlling the operations thereof. The user can execute operations and enter settings of the image controller 71 by entering commands from a computer (not shown) connected to the apparatus body 10, or manipulating the operation unit 80.

The operation unit 80 is formed as a separate body from the apparatus body 10 and capable of being placed movably on the apparatus body 10, for operating the respective sections of the apparatus body 10. The operation unit 80 is equipped with a driver board 81 and a liquid crystal touch panel 82. The liquid crystal touch panel 82 displays necessary information for enabling the user to operate the image forming apparatus 2, such as remaining amounts of sheets S and toner supplied to the apparatus body 10, a warning message when consumable supplies such as sheets or toner run out, and procedures for supplying the consumable supplies. Further, the liquid crystal touch panel 82 accepts input operations from the user related to the size or paper weight of the sheets S, density control of the images, setting of number of output sheets, and so on.

The operation unit 80 is connected to the electrical unit 70 of the apparatus body 10 via a cable 90, through which power can be conducted. The cable 90 is a bundled wire in which a signal line 90*a* and a power line 90*b* are bundled. The signal line 90*a* connects the input/output circuit 76 of the image controller 71 and the driver board 81, and the power line 90*b* connects a power supply 12 of the apparatus body 10 and the driver board 81. The configuration of the connecting section of the operation unit 80 and the electrical unit 70 via the cable 90 will be described later.

Next, we will describe an image forming action according to the image forming apparatus 2 having the above-described configuration.

When the image forming operation is started, at first, photosensitive drums 47*y*, 47*m*, 47*c* and 47*k* are rotated and the surfaces of the drums are respectively charged by charging rollers 48*y*, 48*m*, 48*c* and 48*k*. Thereafter, laser beams are irradiated respectively from exposure units 43*y*, 43*m*, 43*c* and 43*k* to the photosensitive drums 47*y*, 47*m*, 47*c* and 47*k* based on the image information, and electrostatic latent images are formed on the surfaces of the photosensitive drums 47*y*, 47*m*, 47*c* and 47*k*. By having toner adhered to the electrostatic latent images, the electrostatic latent images are developed and visualized as toner images, and the toner images are transferred to the intermediate transfer belt 44*b*.

On the other hand, in parallel with such operation for forming toner images, the feeding roller 32 rotates, separating the uppermost sheet S in the sheet cassette 31 from the pile of sheets S and feeding the sheet. Then, at a matched timing with the toner image on the intermediate transfer belt 44*b*, the sheet S is conveyed via the pre-secondary-transfer conveying path 51 to the secondary transfer portion 45. Further, the image is transferred from the intermediate transfer belt 44*b* to the sheet S, and then the sheet S is conveyed to the fixing unit 46, where the unfixed toner image is heated, pressed and fixed onto the surface of the sheet S, and the sheet S on which the image has been fixed is discharged through the discharge port 62 via the discharge roller pair 61 and supplied to the optional discharge device 3.

Next, the details of the electrical unit 70 and the operation unit 80, specifically the configuration of the connecting section with the cable 90, will be described in detail with respect to FIGS. 4 through 6. In the present embodiment, throughout the whole area between the electrical unit 70 and the operation unit 80, the cable 90 has a free area in which the cable 90 can be moved along with the movement of the operation unit 80. In other words, according to the present embodiment, the whole length of the cable 90 between the electrical unit 70 and the operation unit 80 corresponds to the length of the free area (free length) of the cable.

Figure 4:
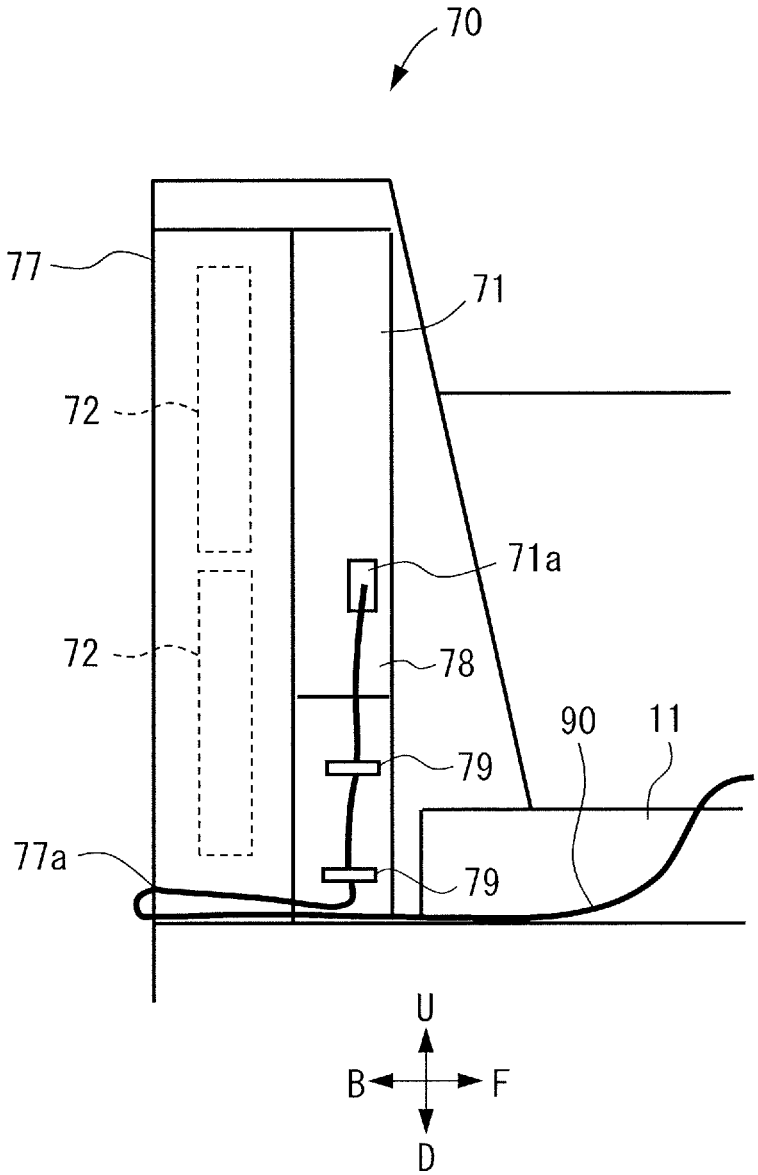
FIG. 4 is a side view showing a state where an outer cover is moved from the electrical unit of the image forming apparatus according to the preferred embodiment.

As shown in FIG. 4, the image controller 71 is supported at the front direction F-side of the electrical unit 70 in the interior thereof, with its direction of thickness arranged in the front-rear direction. Two HDDs 72 are arranged one above the other at the rear direction B-side of the electrical unit 70 in the interior thereof, each HDD positioned upright in a landscape orientation with the thickness direction arranged in the front-rear direction and the longitudinal direction arranged in the left-right direction. According to this arrangement, the thickness of the electrical unit 70 in the front-rear direction can be minimized, so that a wide plane surface 1*b* can be formed on the front direction F-side of the electrical unit 70 to improve the workability.

The electrical unit 70 is equipped with an opening (apparatus body-side retaining portion, boundary portion) 77*a* formed at a lower portion of a rear surface of an outer cover 77, and a clamp 79 provided on a board cover 78 fixed to a frame (not shown). A diameter of the opening 77*a* is equivalent to an outer diameter of the cable 90. The opening 77*a* holds the cable 90 via the electrical unit 70 with respect to the apparatus body 10, and the cable 90 moves with respect to the opening 77*a* when an external tensile force of a given level or greater is applied to the cable 90. In other words, the cable 90 is held by a portion of the electrical unit 70.

The cable 90 is introduced to the interior of the electrical unit 70 from the outer side of the electrical unit 70 through the opening 77*a*, retained by the respective clamps 79 and connected via a connector (apparatus body-side connector) 71*a* to the image controller 71. The cable 90 is laid in the inner side of the electrical unit 70 from the opening 77*a* side along a bottom surface toward the front direction F, bent along the inner surface of the outer cover 77 toward the upper direction U and retained in that manner by the clamps 79. In other words, the cable 90 is not arranged linearly between the connector 71*a* connected to the apparatus body 10 and the opening 77*a* retained movably with respect to the apparatus body 10, but arranged so that one area is bent. The bent arrangement of the cable 90 is maintained by the retention of the clamps 79.

Now, when the operation unit 80 falls down from the plane surface 1*b*, the cable 90 will support the weight of the operation unit 80. For example, if the tensile strength of the cable 90 is 200 N and the weight of the operation unit 80 is approximately 2 kg, the cable is capable of supporting the weight of the operation unit 80 including the shock applied during the fall.

For example, when the operation unit 80 falls down from the plane surface 1*b*, the cable 90 receives external force in a direction being pulled out from the opening 77*a*. In general, the strength of the connector is weaker than the bundled wire, so that there is fear that if the external force acts directly on the connector 71*a*, the connector 71*a* may be pulled out, or the connector 71*a* may even be damaged. On the other hand, according to the present embodiment, the cable 90 is arranged in a bent manner, allowing the external force to be absorbed by having the bent portion of the cable 90 extended until it is arranged linearly between the connector 71*a* and the opening 77*a*, so that it becomes possible to suppress external force from being applied directly on the connector 71*a*. Moreover, even if external force having a strength or tensile length that exceeds the upper limit value is applied, the connector 71*a* or the cable 90 may be damaged by the force, but the expensive image controller 71 can be prevented from being damaged.

Figure 5:
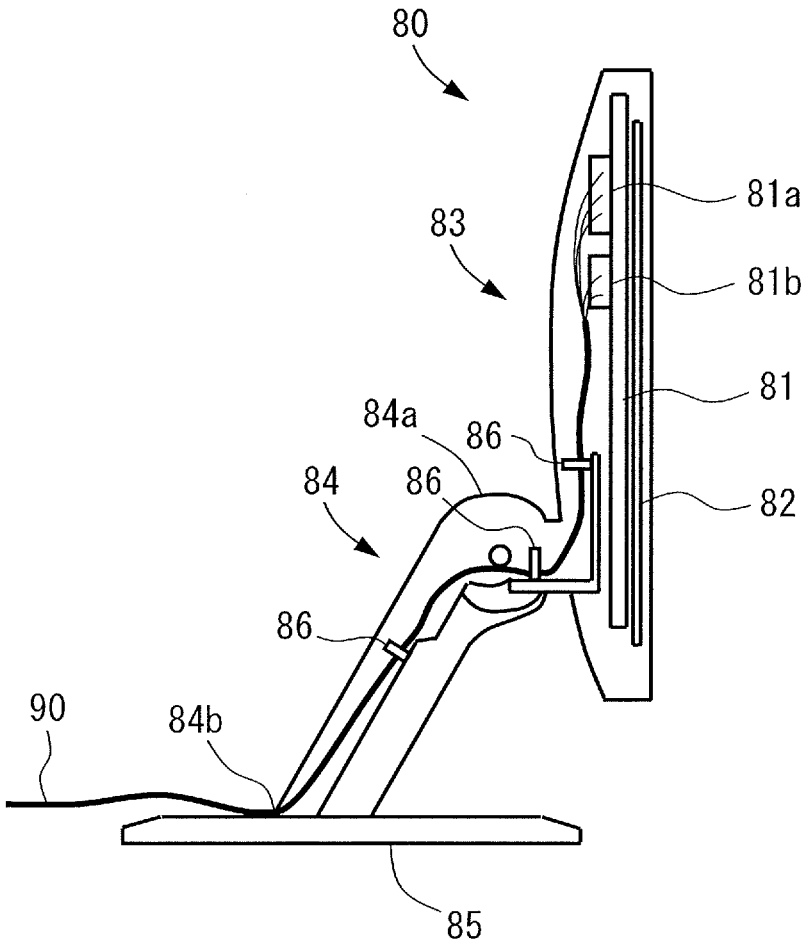
FIG. 5 is a section view of the operation unit according to the preferred embodiment.
Figure 6:
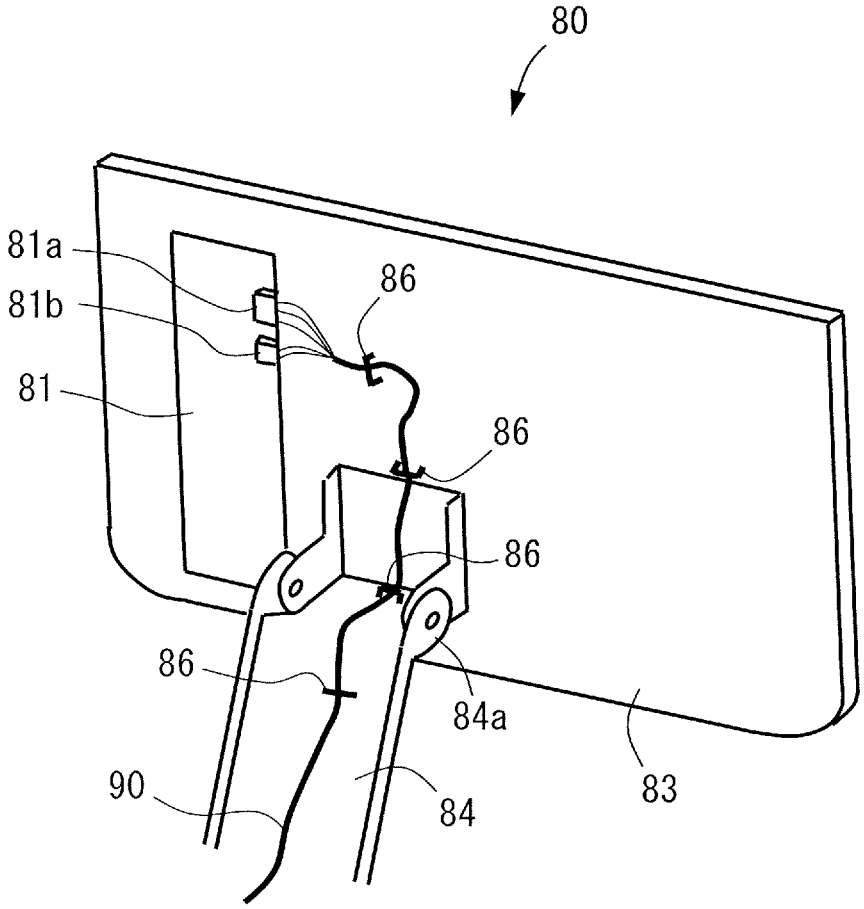
FIG. 6 is a perspective view of the operation unit seen from a rear side with the cover removed according to the preferred embodiment.

As shown in FIGS. 5 and 6, the operation unit 80 is equipped with a main body portion 83, a support column 84 and a leg portion 85. The main body portion 83 stores the driver board 81, and has the liquid crystal touch panel 82 exposed on the front surface. The support column 84 supports the main body portion 83 with respect to the leg portion 85. The support column 84 has a hinge 84*a* capable of adjusting the vertical angle of the main body portion 83, so that the user can adjust the liquid crystal touch panel 82 to realize easier operation or better view.

The operation unit 80 is equipped with an opening (operation unit-side retaining portion, boundary portion) 84*b* formed at a lower portion on the rear surface of the support column 84, and a clamp 86 fixed to an inner surface of the support column 84 and an inner side of the main body portion 83. The diameter of the opening 84*b* is equivalent to an outer diameter of the cable 90. The opening 84*b* retains the cable 90 with respect to the operation unit 80, and the cable 90 moves with respect to the opening 84*b* when an external tensile force of a given level or greater is applied thereto.

The cable 90 is passed through the opening 84*b* from the exterior of the support column 84 to the inner side of the support column 84, retained by the respective clamps 86, and connected to the driver board 81 via connectors (operating portion-side connectors) 81*a* and 81*b*. The signal line 90*a* is connected to the connector 81*a*, through which control signals of the liquid crystal touch panel 82 are communicated, and the power line 90*b* is connected to the connector 81*b*, through which power is supplied from the power supply 12 to the liquid crystal touch panel 82.

The cable 90 is pulled into the main body portion 83 from the uppermost area of the support column 84, arranged along the rear surface of the liquid crystal touch panel 82 toward the upper direction U, and then bent toward the driver board 81 and retained by the clamps 86. That is, the cable 90 is not arranged linearly between the connectors 81*a* and 81*b* connected to the operation unit 80 and the opening 84*b* retained in a movable manner with respect to the operation unit 80, but arranged so that one area thereof is bent. The bent arrangement of the cable 90 is maintained by the retention via the clamps 86.

At this time, for example, if the operation unit 80 falls off from the plane surface 1*b*, external force is applied to the cable in the direction being pulled out from the opening 84*b*. As described, since the cable 90 is arranged in a bent manner according to the present embodiment, the external force can be absorbed until the bent section of the cable 90 is extended linearly between the connectors 81*a* and 81*b* and the opening 84*b*. According to this arrangement, it becomes possible to suppress external force from being applied directly to the connectors 81*a* and 81*b*. Moreover, even if external force having a strength or tensile length that exceeds the upper limit is applied, the connectors 81*a* and 81*b* or the cable 90 may be damaged by the force, but the expensive driver board 81 can be prevented from being damaged.

Next, the length of the cable 90 will be described in detail with reference to FIG. 7. The cable 90 is attached to the apparatus body 10 with such a length that the operation unit 80 will not be in contact with an installation surface (floor surface) 4 on which the apparatus body 10 is supported.

The length of the cable 90 can be determined by the following method, for example. As shown in FIG. 7, it is assumed that the operation unit 80 falls from a plane surface 1*c* (refer to FIG. 1) having the lowest height in the upper surface 10*a* of the apparatus body 10 to the front direction F (refer to imaginary line of FIG. 1). At this time, the distance from the opening 77*a* of the electrical unit 70 to the front surface of the apparatus body 10 is denoted as d1, the height from the installation surface 4 to the plane surface 1*c* is denoted as h1, and the height of the operation unit 80 is denoted as h2. In this case, the length of the cable 90 from the opening 77*a* to the opening 84*b* with the operation unit 80 not being in contact with the installation surface 4, in other words, the length exposed to the outer side of the device, can be calculated by d1+h1−h2.

In this state, it is assumed that the operation unit 80 falls from the lowest plane surface 1*c* of the upper surface 10*a* of the apparatus body 10 to the rear direction B. In that case, the length of the cable 90 from the opening 77*a* to the opening 84*b* with the operation unit 80 not being in contact with the installation surface 4, that is, the length of the cable 90 exposed to the exterior of the device, can be calculated as h1−h2. Since the apparatus body 10 is sufficiently long in the side direction, it is assumed that the operation unit 80 will not fall from the left and right sides. However, if the side length of the apparatus body 10 is not sufficiently long and there is fear that the operation unit 80 may fall from the sides of the apparatus body 10, the length of such case should also be considered.

In other words, according to the present embodiment, the whole length of the cable 90 between the electrical unit 70 and the operation unit 80 determined so that the operation unit 80 will not contact the installation surface 4 is set shorter than the difference between a minimum distance h1 from the opening 77*a* to the installation surface 4 along the apparatus body 10 and a height h2 of the operation unit 80.

Accordingly, in the present embodiment, the length of the cable 90 is set shorter than (h1−h2), so that the operation unit 80 can be prevented from being in contact with the installation surface 4 even if the operation unit 80 falls from the plane surface 1*c* in either the front direction F or the rear direction B (or in the left or right side direction). In the present embodiment, the electrical unit 70 is provided behind the plane surface 1*b*, so that the operation unit 80 mounted on the plane surface 1*b* will not fall easily even when pushed toward the rear direction B.

The method for setting the length of the cable 90 is not restricted to the aforementioned calculation method using the dimension of the apparatus body 10, and for example, the length can be set by actually using the cable 90 to suspend the operation unit 80 to adjust the length of the cable so that the operation unit 80 will not contact the installation surface 4.

Figure 7:
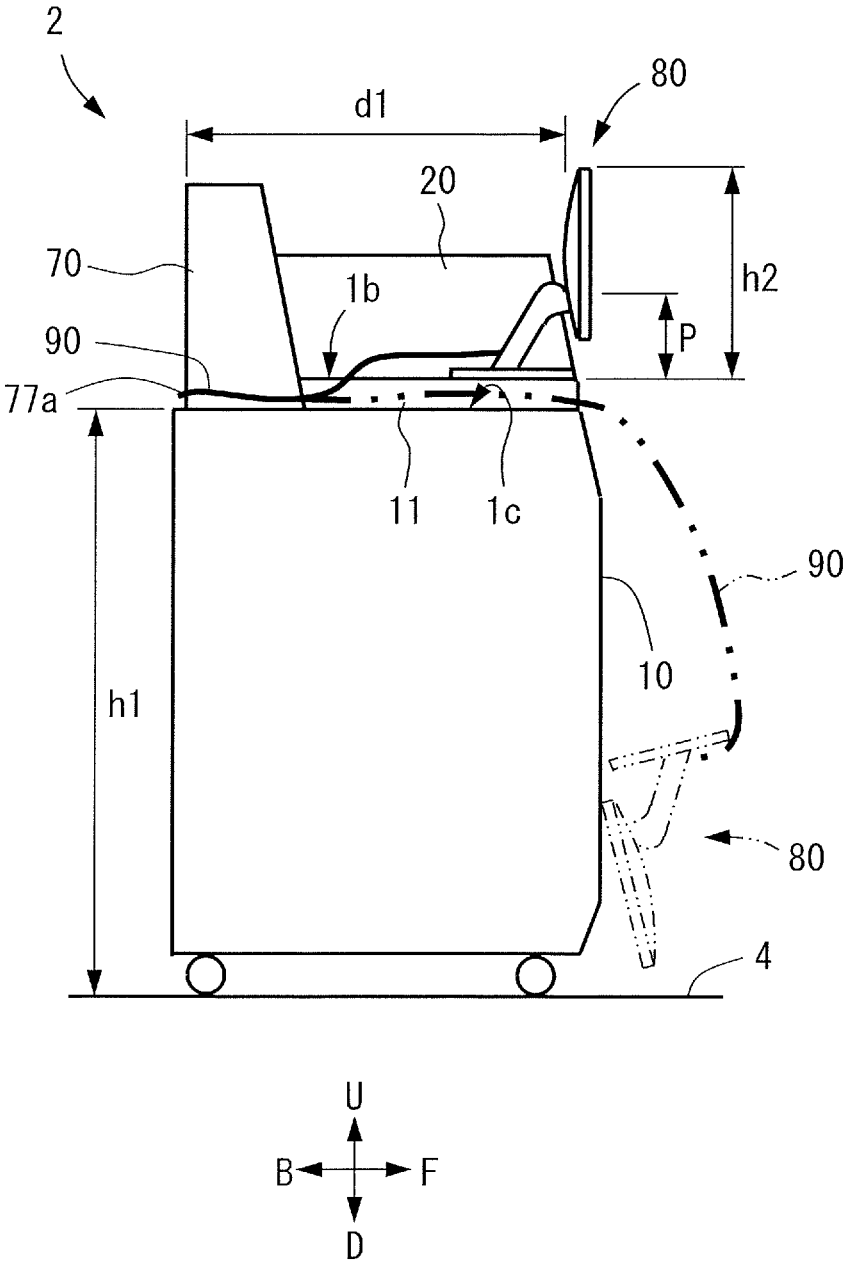
FIG. 7 is a schematic side view of the image forming apparatus according to the preferred embodiment.

Now, as shown in FIG. 7, according to the present embodiment, the height of the electrical unit 70 from the plane surface 1*b* is set equivalent to the height of the operation unit 80 placed on the plane surface 1*b*. That is, if the height of the center of gravity of the operation unit 80 is represented by P, the height of the electrical unit 70 from the plane surface 1*b* is set higher than the position of the center of gravity of the operation unit 80 mounted on the plane surface 1*b*. Thereby, even if the operation unit 80 collapses in the rear direction, the possibility of the unit 80 moving beyond the electrical unit 70 and falling can be minimized. In the present embodiment, the height of the electrical unit 70 is set equivalent as the height of the operation unit 80, but the height of the electrical unit 70 can be set lower. For example, even if the operation unit 80 is pushed by a strong force toward the rear direction B by an operational error of the user and moves rearward, if the electrical unit 70 has a sufficient height to function as a stopper, the user can get the sense of the limit position.

We will describe the state of use of the above-described operation unit 80 in detail. As shown in FIG. 1, during normal use of the image forming system 1, the user places the operation unit 80 on the plane surface 1*b*, for example, for use. At this time, the liquid crystal touch panel 82 of the operation unit 80 faces the front direction F. When the user manipulates the operation unit 80, the signals related to the operation are transmitted via the cable 90 to the image controller 71, and the image forming apparatus 2 is controlled thereby.

Since the cable 90 has flexibility, the user can place the operation unit 80 at any arbitrary position on the plane surface 1*b* according to preference, or at any arbitrary position on other plane surfaces 1*a* and 1*c*, in the reachable range of the cable 90, or even on the top surface of the optional discharge device 3. Thus, the user can set the position of the operation unit 80 according to workflow, and the efficiency of the workflow can be improved.

For example, it is possible to place the output sheet S on the widest plane surface 1*c* for image confirmation, and place the operation unit 80 on the plane surface 1*c* adjacent to the sheet S to adjust the image formation while looking at the sheet S. In that case, the user can perform a continuous operation of placing the sheet S discharged from the optional discharge device 3 on the plane surface 1*c*, confirming the image, and entering adjustment values in the operation unit 80, so that the efficiency of workflow can be improved.

Figure 8:
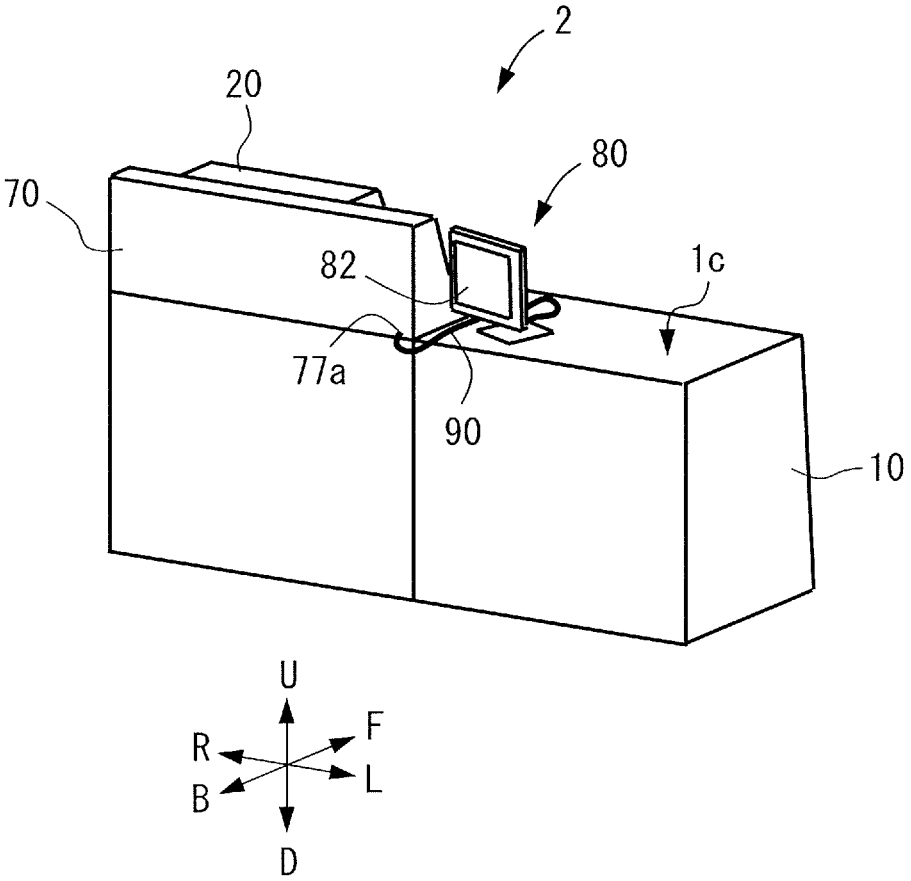
FIG. 8 is a perspective view from a rear side of the image forming apparatus according to the preferred embodiment.

Further, as shown in FIG. 8, when a service person performs maintenance operation from the rear of the image forming apparatus 2, the operation unit 80 can be placed facing the rear direction B. Thereby, the service person can acquire the desired information using the operation unit 80 while actually confirming the failure location from the rear. Furthermore, when there is a need to operate the motor independently for confirmation of operation of the driving portion, the service person can execute commands using the operation unit 80 without having to move around. Thus, the workability during maintenance can be improved, and the processing speed can be enhanced.

Since the operation unit 80 can be placed anywhere, some users may place the operation unit 80 on the front side of the plane surface 1*b*. In that case, the operation unit 80 may fall off the plane surface 1*b* due to erroneous placement by the user, unexpected contact with the operation unit 80, earthquakes, and so on. If the operation unit 80 comes in strong contact with the installation surface 4, there is fear that the operation unit may be damaged or broken, but according to the image forming apparatus 2 of the present embodiment, the operation unit 80 that has fallen from the plane surface is suspended and held by the cable 90, and is prevented from being in contact with the installation surface 4.

As described, according to the image forming apparatus 2 of the present embodiment, the apparatus body 10 and the operation unit 80 are connected via the cable 90, so that the freedom of placement of the operation unit 80 can be increased compared to the case where the two members are connected via an arm. Thereby, the movable range of the operation unit 80 can be expanded, allowing the user to set the position of the operation unit 80 according to workflow, and the workflow efficiency can be improved. Further, during maintenance operation, such as during failure, the operator can use the operation unit 80 to realize improved workability and enhanced processing speed.

Further according to the image forming apparatus 2 of the present embodiment, the length of the cable 90 is set to such a length that the operation unit 80 will not contact the installation surface 4 on which the apparatus body 10 is supported. Therefore, even if the operation unit 80 falls from the apparatus body 10 by an earthquake or the like, the operation unit 80 can be prevented from being in contact with the installation surface 4 and breaking.

According further to the image forming apparatus 2 of the present embodiment, since the image controller 71 is built in the electrical unit 70, the length of the cable 90 to the operation unit can be minimized, and the occurrence of communication troubles caused by noise and the like can be suppressed.

According even further to the image forming apparatus 2 of the present embodiment, the cable 90 is arranged in a bent manner within the electrical unit 70. Therefore, the external force can be absorbed by having the bent area of the cable 90 extended linearly between the connector 71*a* and the opening 77*a*, so that it becomes possible to suppress external force from being applied directly to the connector 71*a*. Similarly, the cable 90 is arranged in a bent manner within the operation unit 80. Therefore, the external force can be absorbed by having the bent area of the cable 90 extended linearly between the connectors 81*a*, 81*b* and the opening 84*b*, so that it becomes possible to suppress external force from being applied directly to the connectors 81*a* and 81*b*.

Figure 9:
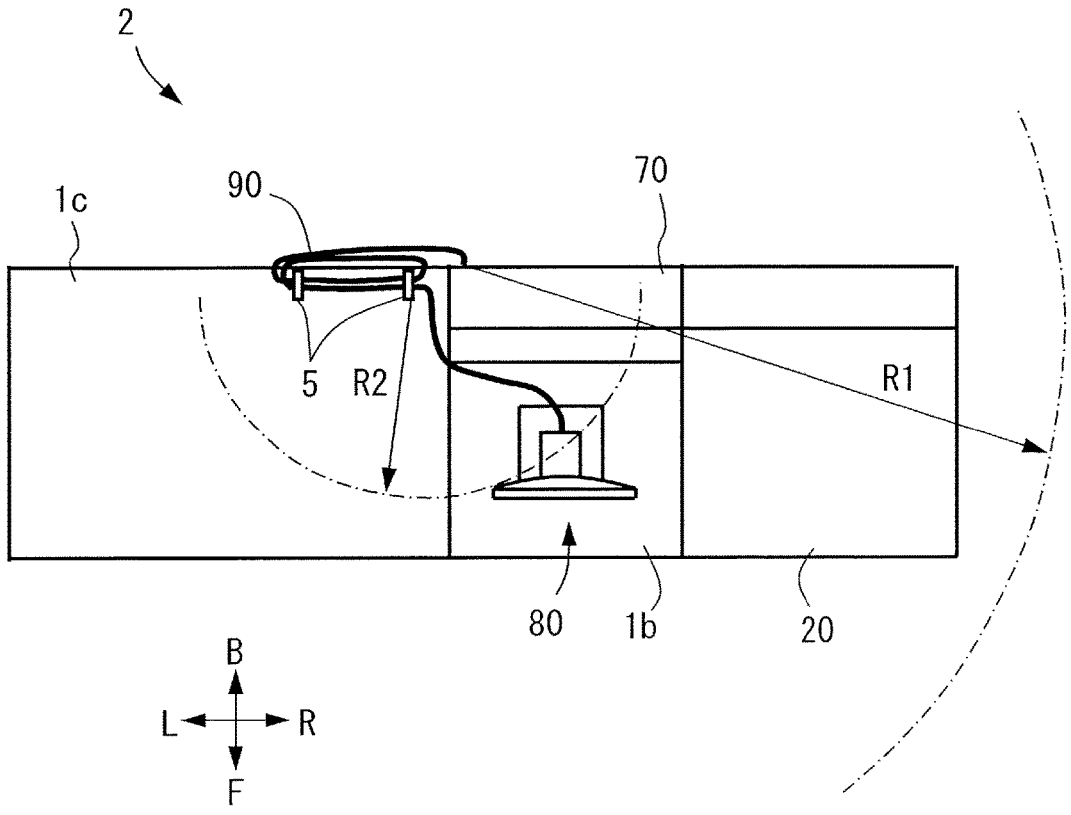
FIG. 9 is a schematic plane surface view of a modified example of an image forming apparatus according to the preferred embodiment.

The preferred embodiment described above illustrates an example where the whole area from the opening 77*a* to the opening 84*b* is set as the free area of the cable 90 in which the cable 90 can move along with the movement of the operation unit 80, but the present invention is not restricted to such example. For example, as shown in FIG. 9, it is possible to provide a plurality of hook-like winding members (winding portions) 5 capable of having the cable 90 wound around the members and reducing the movable range of the operation unit 80. The winding members 5 are designed to protrude upward from the rear side of the upper surface 10*a* of the apparatus body 10. By winding the cable 90 around the respective winding members 5, the length of the cable 90 can be adjusted shorter, so that a radius R1 of the original movable range can be reduced appropriately, and for example, it can be set to a radius R2 preventing the operation unit 80 from falling from the front side of the plane surface 1*b* and the plane surface 1*c*. Further, since the winding members 5 and the cable 90 wound around the members are placed on the rear side of the upper surface 10*a* of the apparatus body 10, the operation unit 80 placed on the plane surface 1*b* and the plane surface 1*c* will contact the members when pushed toward the rear direction, and the operation unit 80 can be prevented from falling from the rear direction.

The present embodiment has illustrated an example where the cable 90 has a length determined so that when the operation unit 80 falls from the plane surface 1*b*, the unit 80 reaches a height close to the installation surface 4, but the present invention is not restricted to such example. For example, it is possible to set the length of the cable 90 shorter so that the operation unit 80 will not fall from the plane surface 1*b* (refer to FIG. 9).

According even further to the present embodiment, an example has been illustrated of a case where the whole area between the electrical unit 70 and the operation unit 80 is set as the free area of the cable 90 in which the cable can move along with the movement of the operation unit 80, but the present invention is not restricted to such example. For example, an adjustment portion capable of adjusting the length of the free area of the cable 90 can be provided. In that case, even if the cable 90 has a length so long that the operation unit 80 will contact the installation surface 4 if the whole area between the electrical unit 70 and the operation unit 80 is set as the free area, the adjustment portion can be used to limit the length of the free area of the cable 90 so that the operation unit 80 will not contact the installation surface 4.

In other words, the length of the free area of the cable 90 between the apparatus body 10 and the operation unit 80 when the operation unit 80 does not contact the installation surface 4 is set smaller than the difference between the height of the operation unit 80 and the minimum distance from a final retaining position of the cable 90 on the side of the apparatus body 10 to the installation surface 4 along the apparatus body 10.

The adjustment portion of this arrangement can be set as a supporting portion supporting at least a portion of the cable 90 in the bent state. In that case, the supporting portion can be, for example, a hook, a pinching member or a winding member and the like disposed at least on either the apparatus body 10 or the operation unit 80 (refer to winding member 5 of FIG. 9). In the arrangement, the supporting portion is arranged on a side surface or an upper surface of the electrical unit 70 or the rear side of the plane surface 1*b* or the plane surface 1*c*, for example, in the apparatus body 10, and arranged on the rear surface side, for example, in the operation unit 80. Thus, by adjusting and reducing the length of the free area of the cable 90, it becomes possible to set the length of the free area of the cable 90 to a length so that the operation unit 80 will not contact the installation surface 4.

The arrangement of the adjustment portion is not restricted to the arrangement for retaining at least a portion of the cable 90 in a bent state, and it is also possible to arrange the cable 90 in the linear state but with only area of the cable 90 being fixed to at least either the apparatus body 10 or the operation unit 80. In that case, since the length of the cable 90 beyond the area fixed by the adjustment portion becomes the free area, it is possible to shorten the length of the free area by setting the length so that the operation unit 80 will not contact the installation surface 4.

In the present embodiment, a case has been illustrated where the electrical unit 70 is applied as the partition unit, but the present invention is not restricted thereto. For example, a simple partition unit that does not store any electrical component can be provided instead of the electrical unit 70.

Further according to the present embodiment, the image forming apparatus 2 of the image forming system 1 equipped with the optional discharge device 3 has been described, but the present invention is not restricted thereto. For example, the present invention can be applied to an independent image forming apparatus having an image reading portion and a discharge tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming system comprising:

an image forming apparatus configured to form an image on a recording member;

an operation unit configured to operate the image forming apparatus, the operation unit comprising an operation portion and a stand portion configured to be attached to the operation portion and to stand on a top surface of the image forming apparatus;

a cable configured to electrically communicate between the image forming apparatus and the operation unit, the cable being connected with the operation unit while a part of the cable is exposed from the image forming apparatus; and an anchor portion provided on a rear side of the top surface of the image forming apparatus and configured to anchor the exposed part of the cable at a predetermined portion of the rear side of the top surface of the image forming apparatus, wherein, in a state where the exposed part of the cable is anchored at the predetermined portion, a length of a free area of the cable, which is located on a free end side beyond the predetermined portion, is such a length that the stand portion is capable of standing at least at two positions of the top surface of the image forming apparatus, and that the operation unit cannot reach an installation surface of the image forming apparatus if the operation unit falls from the top surface of the image forming apparatus in a rear direction, and wherein the cable has a strength capable of supporting the operation unit if the operation unit falls from the top surface of the image forming apparatus in the rear direction.

2. The image forming system according to claim 1, wherein the length of the free area of the cable is such a length that the stand portion is capable of standing on the top surface of the image forming apparatus in a state where the operation unit is facing toward a front side and a rear side of the image forming apparatus, respectively.

3. The image forming system according to claim 1, wherein the length of the free area of the cable is longer than a length from a rear surface side to a front surface side of the image forming apparatus.

4. The image forming system according to claim 1, wherein the image forming apparatus comprises a first body and a second body, wherein the anchor portion is provided on a rear side of the top surface of the first body, and wherein the predetermined portion is located on the rear side of the top surface of the first body.

5. The image forming system according to claim 1, wherein the anchor portion comprises a hook.

6. The image forming system according to claim 1, wherein the cable is configured to supply electrical power to the operation unit.

7. The image forming system according to claim 1, wherein the cable is configured to communicate a signal between the image forming apparatus and the operation unit.

8. The image forming system according to claim 1, further comprising a clamp configured to retain the cable at a predetermined portion of the operation unit, wherein in a state where the exposed part of the cable is anchored by the anchor portion at the predetermined portion of the image forming apparatus, a length of the free area of the cable retained by the clamp at the predetermined portion of the image forming apparatus, is such a length that the stand portion is capable of standing at least at the two positions of the top surface of the image forming apparatus, and that the operation unit cannot reach the installation surface of the image forming apparatus if the operation unit falls from the top surface of the image forming apparatus in the rear direction.

9. An image forming system comprising:

an image forming apparatus configured to form an image on a recording member;

an operation unit configured to operate the image forming apparatus, the operation unit comprising an operation portion and a stand portion configured to be attached to the operation portion and to stand on a top surface of the image forming apparatus;

a cable configured to electrically communicate between the image forming apparatus and the operation unit, the cable being connected with the operation unit while a part of the cable is exposed to an outer side of the image forming apparatus; and an anchor portion provided on a rear side of the top surface of the image forming apparatus and configured to anchor the exposed part of the cable at first and second portions on the rear side of the top surface of the image forming apparatus, wherein, in a state where the exposed part of the cable is anchored at the first and second portions, a length of a free area of the cable, which is located on a free end side beyond the first and second positions, is such a length that the stand portion is capable of standing at least at two positions of the top surface of the image forming apparatus, and that the operation unit cannot reach an installation surface of the image forming apparatus if the operation unit falls from the top surface of the image forming apparatus in a rear direction, and wherein the cable has a strength capable of supporting the operation unit if the operation unit falls from the top surface of the image forming apparatus in the rear direction.

10. The image forming system according to claim 9, wherein the length of the free area of the cable is such a length that the stand portion is capable of standing on the top surface of the image forming apparatus in a state where the operation unit is facing toward a front side and a rear side of the image forming apparatus, respectively.

11. The image forming system according to claim 9, wherein the length of the free area of the cable is longer than a length from a rear surface side to a front surface side of the image forming apparatus.

12. The image forming system according to claim 9, wherein the image forming apparatus comprises a first body and a second body, wherein the anchor portion is provided on a rear side of the top surface of the first body, and wherein the first and second portions are provided on the rear side of the top surface of the first body.

13. The image forming system according to claim 9, wherein the anchor portion comprises a hook.

14. The image forming system according to claim 9, wherein the cable is configured to supply electrical power to the operation unit.

15. The image forming system according to claim 9, wherein the cable is configured to communicate a signal between the image forming apparatus and the operation unit.

16. The image forming system according to claim 9, further comprising a clamp configured to retain the cable at a predetermined portion of the operation unit, wherein, in a state where the exposed part of the cable is anchored by the anchor portion at the first and second portions of the image forming apparatus, a length of the free area of the cable retained by the clamp beyond the first and second portions of the operation unit, which is located on the free end side beyond the first and second portions of the image forming apparatus, is such a length that the stand portion is capable of standing at least the two positions of the top surface of the image forming apparatus, is such a length that the stand portion is capable of standing at least at two positions of the top surface of the image forming apparatus, and that the operation unit cannot reach the installation surface of the image forming apparatus if the operation unit falls from the top surface of the image forming apparatus in the rear direction.

17. An image forming system comprising:

an image forming apparatus configured to form an image on a recording member;

an operation unit configured to operate the image forming apparatus, the operation unit comprising an operation portion and a stand portion configured to be attached to the operation portion and to stand on a top surface of the image forming apparatus;

a cable configured to electrically communicate between the image forming apparatus and the operation unit, the cable being connected with the operation unit while a part of the cable is exposed to an outer side of the image forming apparatus at a position on one side of the image forming apparatus; and an anchor portion configured to anchor the exposed part of the cable at a predetermined portion of the image forming apparatus, wherein, in a state where the exposed part of the cable is anchored at the predetermined portion, a length of a free area of the cable, which is located on a free end side beyond the predetermined portion, is such a length that the stand portion is capable of standing at least at two positions of the top surface of the image forming apparatus and that the operation unit cannot reach an installation surface of the image forming apparatus if the operation unit falls from the top surface of the image forming apparatus to the one side of the image forming apparatus from which the part of the cable is exposed, and wherein the cable has a strength capable of supporting the operation unit if the operation unit falls from the top surface of the image forming apparatus to the one side of the image forming apparatus from which the part of the cable is exposed.

18. The image forming system according to claim 17, wherein the anchor portion is provided on the top surface of the image forming apparatus, and wherein the predetermined portion is located on the top surface of the image forming apparatus.

19. The image forming system according to claim 17, wherein the length of the free area of the cable is such a length that the stand portion is capable of standing on the top surface of the image forming apparatus in a state where the operation unit is facing toward a front surface side and a rear surface side of the image forming apparatus, respectively.

20. The image forming system according to claim 17, wherein the length of the free area of the cable is longer than a length from a rear surface side to a front surface side of the image forming apparatus.

21. The image forming system according to claim 17, wherein the image forming apparatus comprises a first body and a second body, wherein the anchor portion is provided on the first body, and wherein the predetermined portion is located on the first body.

22. The image forming system according to claim 17, wherein the anchor portion comprises a hook.

23. The image forming system according to claim 17, wherein the cable is configured to supply electrical power to the operation unit.

24. The image forming system according to claim 17, wherein the cable is configured to communicate a signal between the image forming apparatus and the operation unit.

25. The image forming system according to claim 17, further comprising a clamp configured to retain the cable at a predetermined portion of the operation unit, wherein, in a state where the exposed part of the cable is anchored by the anchor portion at the predetermined portion of the image forming apparatus, a length of the free area of the cable retained by the clamp at the predetermined portion of the operation unit, which is located on the free end side beyond the predetermined portion of the image forming apparatus, is such a length that the stand portion is capable of standing at least at the two positions of the top surface of the image forming apparatus, and that the operation unit cannot reach the installation surface of the image forming apparatus if the operation unit falls from the top surface of the image forming apparatus to the one side of the image forming apparatus from which the part of the cable is expose.

26. An image forming system comprising:

an image forming apparatus configured to form an image on a recording member, an operation unit configured to operate the image forming apparatus, the operation unit comprising an operation portion and a stand portion configured to be attached to the operation portion and to stand on a top surface of the image forming apparatus;

a cable configured to electrically communicate between the image forming apparatus and the operation unit, the cable being connected with the operation unit while a part of the cable is exposed from the image forming apparatus at a position on a rear side of the image forming apparatus; and a pinching portion configured to pinch the exposed part of the cable at a predetermined portion of the image forming apparatus, wherein, in a state where the exposed part of the cable is pinched at the predetermined portion, a length of a free area of the cable, which is located on a free end side beyond the predetermined portion, is such a length that the stand portion is capable of standing at least at two positions of the top surface of the image forming apparatus, and that the operation unit cannot reach an installation surface of the image forming apparatus if the operation unit falls from the top surface of the image forming apparatus in a rear direction, and wherein the cable has a strength capable of supporting the operation unit if the operation unit falls from the top surface of the image forming apparatus in the rear direction.

27. The image forming apparatus according to claim 26, wherein the pinching portion is provided on the top surface of the image forming apparatus, and wherein the predetermined portion is located on the top surface of the image forming apparatus.

28. The image forming system according to claim 27, wherein the pinching portion is provided on a rear side of the top surface of the image forming apparatus, and wherein the predetermined portion is located on the rear side of the top surface of the image forming apparatus.

29. The image forming system according to claim 26, wherein the length of the free area of the cable is such a length that the stand portion is capable of standing on the top surface of the image forming apparatus in a state where the operation unit is facing toward a front side and a rear side of the image forming apparatus, respectively.

30. The image forming system according to claim 26, wherein the length of the free area of the cable is longer than a length from a rear surface side to a front surface side of the image forming apparatus.

31. The image forming system according to claim 26, wherein the image forming apparatus comprises a first body and a second body, wherein the pinching portion is provided on the first body, and wherein the predetermined portion is located on the first body.

32. The image forming system according to claim 26, wherein the cable is configured to supply electrical power to the operation unit.

33. The image forming system according to claim 26, wherein the cable is configured to communicate a signal between the image forming apparatus and the operation unit.

34. The image forming system according to claim 26, further comprising a clamp configured to retain the cable at a predetermined portion of the operation unit, wherein, in a state where the exposed part of the cable is pinched by the pinching portion at the predetermined portion of the image forming apparatus, a length of the free area of the cable retained by the clamp at the predetermined portion of the operation unit, which is located on the free end side beyond the predetermined portion of the image forming apparatus, is such a length that the stand portion is capable of standing at least at the two positions of the top surface of the image forming apparatus, and that the operation unit cannot reach the installation surface of the image forming apparatus if the operation unit falls from the top surface of the image forming apparatus in the rear direction.

35. An image forming system comprising:

an image forming apparatus configured to form an image on a recording member, an operation unit configured to operate the image forming apparatus, the operation unit comprising an operation portion and a stand portion configured to be attached to the operation portion and to stand on a top surface of the image forming apparatus;

a cable configured to electrically communicate between the image forming apparatus and the operation unit, the cable being connected with the operation unit while a part of the cable is exposed from the image forming apparatus at a position on a rear side of the image forming apparatus; and a pinching portion configured to pinch the exposed part of the cable at first and second portions on the image forming apparatus, wherein, in a state where the exposed part of the cable is pinched at the first and second portions, a length of a free area of the cable, which is located on a free end side beyond the first and second portions, is such a length that the stand portion is capable of standing at least at two positions of the top surface of the image forming apparatus if the operation unit falls from the top surface of the image forming apparatus in a rear direction, and wherein the cable has a strength capable of supporting the operation unit if the operation unit falls from the top surface of the image forming apparatus in the rear direction.

36. The image forming system according to claim 35, wherein the pinching portion is provided on the top surface of the image forming apparatus, and wherein the first and second portions are located on the top surface of the image forming apparatus.

37. The image forming system according to claim 36, wherein the pinching portion is provided on a rear side of the top surface of the image forming apparatus, and wherein the first and second portions are located on the rear side of the top surface of the image forming apparatus.

38. The image forming system according to claim 35, wherein the length of the free area of the cable is such a length that the stand portion is capable of standing on the top surface of the image forming apparatus in a state where the operation unit is facing toward a front side and a rear side of the image forming apparatus, respectively.

39. The image forming system according to claim 35, wherein the length of the free area of the cable is longer than a length from a rear surface side to a front surface side of the image forming apparatus.

40. The image forming system according to claim 35, wherein the image forming apparatus comprises a first body and a second body, wherein the pinching portion is provided in on the first body, and wherein the first and second portions are provided on the first body.

41. The image forming system according to claim 35, wherein the cable is configured to supply electrical power to the operation unit.

42. The image forming system according to claim 35, wherein the cable is configured to communicate a signal between the image forming apparatus and the operation unit.

43. The image forming system according to claim 35, further comprising a clamp configured to retain the cable at a predetermined portion of the operation unit, wherein, in a state where the exposed part of the cable is pinched by the pinching portion at the first and second portions of the image forming apparatus, the length of a free area of the cable retained by the clamp at the predetermined portion of the operation unit, which is located on the free end side beyond the first and second portions of the image forming apparatus, is such a length that the stand portion is capable of standing at least at the two positions of the top surface of the image forming apparatus, and that the operation unit cannot reach the installation surface of the image forming apparatus if the operation unit falls from the top surface of the image forming apparatus in the rear direction.

44. A image forming system comprising:

an image forming apparatus configured to form an image on a recording member, an operation unit configured to operate the image forming apparatus, the operation unit comprising an operation portion and a stand portion configured to be attached to the operation portion and to stand on a top surface of the image forming apparatus;

a cable configured to electrically communicate between the image forming apparatus and the operation unit, the cable being connected with the operation unit while a part of the cable is exposed from the image forming apparatus at a position on one side of the image forming apparatus; and a pinching portion configured to pinch the exposed part of the cable at a predetermined portion of the image forming apparatus, a pinching portion configured to pinch the exposed part of the cable at a predetermined portion of the image forming apparatus, wherein, in a state where the exposed part of the cable is pinched at the predetermined portion, a length of a free area of the cable, which is located on a free end side beyond the predetermined portion, is such a length that the stand portion is capable of standing at least at two positions of the top surface of the image forming apparatus if the operation unit falls from the top surface of the image forming apparatus to the one side of the image forming apparatus from which the part of the cable is exposed, and wherein the cable has a strength capable of supporting the operation unit if the operation unit falls from the top surface of the image forming apparatus to the one side of the image forming apparatus from which the part of the cable is exposed.

45. The image forming system according to claim 44, wherein the pinching portion is provided on the top surface of the image forming apparatus, and wherein the predetermined portion is located on the top surface of the image forming apparatus.

46. The image forming system according to claim 44, wherein the length of the free area of the cable is such a length that the stand portion is capable of standing on the top surface of the image forming apparatus in a state where the operation unit is facing toward a front side and a rear side of the image forming apparatus, respectively.

47. The image forming system according to claim 44, wherein the length of the free area of the cable is longer than a length from a rear surface side to a front surface side of the image forming apparatus.

48. The image forming system according to claim 44, wherein the image forming apparatus comprises a first body and a second body, wherein the pinching portion is provided on the first body, and wherein the predetermined portion is located on the first body.

49. The image forming system according to claim 44, wherein the cable is configured to supply electrical power to the operation unit.

50. The image forming system according to claim 44, wherein the cable is configured to communicate a signal between the image forming apparatus and the operation unit.

51. The image forming system according to claim 44, further comprising a clamp configured to retain the cable at a predetermined portion of the operation unit, wherein, in a state where the exposed part of the cable is pinched by the pinching portion at the predetermined portion of the image forming apparatus, a length of the free area of the cable retained by the clamp at the predetermined portion of the operation unit, which is located on the free end side beyond the predetermined portion of the image forming apparatus, is such a length that the stand portion is capable of standing at least at the two positions of the top surface of the image forming apparatus, and that the operation unit cannot reach the installation surface of the image forming apparatus if the operation unit falls from the top surface of the image forming apparatus to the one side of the image forming apparatus from which the part of the cable is exposed.

* * * * *